US008046978B2

(12) United States Patent
Pipes

(10) Patent No.: US 8,046,978 B2
(45) Date of Patent: Nov. 1, 2011

(54) EQUIPMENT AND METHOD FOR PACKAGING MULTIPLE PACKETS OF CIGARETTES

(75) Inventor: Jerry Wayne Pipes, Clemmons, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 145 days.

(21) Appl. No.: 12/572,857

(22) Filed: Oct. 2, 2009

(65) Prior Publication Data

US 2011/0078980 A1 Apr. 7, 2011

(51) Int. Cl.
*B65B 35/50* (2006.01)
*B65B 13/02* (2006.01)

(52) U.S. Cl. ..... 53/540; 53/447; 53/590; 53/399

(58) Field of Classification Search ..... 53/399, 53/443, 447, 147, 537, 540, 582, 586, 590, 53/252, 131.4, 131.5
See application file for complete search history.

(56) References Cited

U.S. PATENT DOCUMENTS

| | | | | | |
|---|---|---|---|---|---|
| 2,383,728 | A | | 8/1945 | Little | |
| 3,695,422 | A | | 10/1972 | Tripodi | 206/47 R |
| 3,850,282 | A | * | 11/1974 | Calvert et al. | 198/418.4 |
| 3,858,788 | A | | 1/1975 | Phillips, Jr. | 229/44 CB |
| 3,874,581 | A | | 4/1975 | Fox et al. | 229/44 CB |
| 3,899,863 | A | | 8/1975 | Seragnoli et al. | 53/53 |
| 3,944,066 | A | | 3/1976 | Niepmann | 206/268 |
| 4,617,780 | A | * | 10/1986 | Focke et al. | 53/466 |
| 4,685,993 | A | * | 8/1987 | Flaherty et al. | 156/475 |
| 4,717,017 | A | | 1/1988 | Sprinkel, Jr. et al. | 206/264 |
| 4,836,378 | A | | 6/1989 | Lephardt | 206/459 |
| 4,852,734 | A | | 8/1989 | Allen et al. | 206/273 |
| 4,928,817 | A | | 5/1990 | Focke | 206/256 |
| 4,932,534 | A | * | 6/1990 | Focke et al. | 229/120.011 |
| 5,101,609 | A | | 4/1992 | Cook | 53/53 |
| 5,123,226 | A | | 6/1992 | Near | 53/75 |
| 5,139,140 | A | | 8/1992 | Burrows et al. | 206/268 |
| 5,160,023 | A | | 11/1992 | Adams et al. | 206/256 |
| 5,192,262 | A | | 3/1993 | Amendola et al. | 493/365 |
| 5,248,031 | A | | 9/1993 | Burrows et al. | 206/268 |
| 5,249,416 | A | | 10/1993 | Adams et al. | 53/463 |
| 5,333,729 | A | | 8/1994 | Wolfe | 206/268 |
| 5,383,322 | A | | 1/1995 | Collins, Jr. et al. | 53/53 |
| 5,412,923 | A | * | 5/1995 | Lashyro et al. | 53/399 |
| 5,430,992 | A | * | 7/1995 | Olson | 53/399 |
| 5,461,842 | A | * | 10/1995 | Brizzi et al. | 53/234 |
| 5,469,687 | A | * | 11/1995 | Olson | 53/48.1 |
| 5,473,862 | A | * | 12/1995 | Brizzi et al. | 53/447 |
| 5,542,529 | A | | 8/1996 | Hein, III et al. | 206/245 |

(Continued)

*Primary Examiner* — Paul Durand
(74) *Attorney, Agent, or Firm* — Brinks Hofer Gilson & Lione

(57) ABSTRACT

A machine for sleeving one or more packages of smoking articles is provided. The machine can provide a blank from a roll of continuous material and fold the blank around packages. The machine includes a sleeve folding station that can orient the blank to be folded around the packages. The sleeve folding station is also configured to permit at least one fold in the blank when the package is moved against the blank and into a pocket. The machine may include a bundling unit adapted to arrange packages into a bundle. The machine can include an adhesive applicator to apply adhesive to the blank so that when folded the blank can be attached to itself to form a sleeved package. Preferably, the machine includes a transfer wheel having a pocket for receiving the blank and bundle together, where upon rotation of the wheel the blank is folded around the bundle.

22 Claims, 6 Drawing Sheets

U.S. PATENT DOCUMENTS

| | | | | |
|---|---|---|---|---|
| 5,595,803 | A | 1/1997 | May et al. | 428/43 |
| 5,680,745 | A | 10/1997 | Brizzi et al. | 53/448 |
| 5,682,986 | A | 11/1997 | Cobler | 206/265 |
| 6,000,196 | A | 12/1999 | Boldrini et al. | 53/410 |
| 6,173,551 | B1 * | 1/2001 | Bowman et al. | 53/131.4 |
| 6,516,589 | B1 * | 2/2003 | Draghetti et al. | 53/466 |
| 6,675,556 | B2 * | 1/2004 | Bertuzzi et al. | 53/234 |
| 6,694,708 | B2 | 2/2004 | Brizzi et al. | 53/462 |
| 6,698,158 | B2 * | 3/2004 | Spatafora | 53/77 |
| 6,932,219 | B2 | 8/2005 | Chacko et al. | 206/526 |
| 6,941,728 | B1 | 9/2005 | Bray et al. | 53/449 |
| 6,964,150 | B2 * | 11/2005 | Battisti | 53/541 |
| 7,257,936 | B2 * | 8/2007 | Salicini et al. | 53/482 |
| 7,281,540 | B2 | 10/2007 | Barnes et al. | 131/284 |
| 7,325,382 | B2 | 2/2008 | Nelson et al. | 53/444 |
| 7,409,956 | B2 | 8/2008 | Hancock et al. | 131/280 |
| 7,415,812 | B2 | 8/2008 | Bray et al. | 53/444 |
| 7,458,196 | B2 * | 12/2008 | Federici et al. | 53/449 |
| 7,475,525 | B2 * | 1/2009 | Focke et al. | 53/447 |
| 7,503,153 | B2 * | 3/2009 | De Matteis | 53/230 |
| 7,900,424 | B2 * | 3/2011 | Bertuzzi et al. | 53/466 |
| 2006/0168909 | A1 * | 8/2006 | Miyaoka et al. | 53/64 |
| 2008/0099353 | A1 | 5/2008 | Parsons et al. | 206/266 |

* cited by examiner

EQUIPMENT AND METHOD FOR PACKAGING MULTIPLE PACKETS OF CIGARETTES

BACKGROUND

1. Field of Technology

The preferred embodiments described herein relate to packaging of products made or derived from tobacco, or that otherwise incorporate tobacco, and are intended for human consumption. In particular, they relate to equipment and methods for packaging at least one pack of smoking articles.

2. Background of Technology

Smoking articles, such as cigarettes, conventionally have been sold in packages, usually called cigarette packs. Cigarette packs are generally rectangular parallelepiped in shape, having front and back long walls and two short side walls. Typically, each full package contains about twenty (20) cigarettes, although the packages can have various shapes and/or contain less than or more than twenty cigarettes. See, for example, U.S. Patent Publ. No. 2008/0099353 to Parsons et al., which is incorporated herein by reference in its entirety. One type of popular cigarette package employs a container having the form of a so-called "soft package" or "soft pack". See, for example, U.S. Pat. Nos. 2,383,728 to Little; 3,695,422 to Tripodi; 4,717,017 to Sprinkel, Jr., et al.; and 5,333,729 to Wolfe, each of which is incorporated herein by reference in its entirety. Another type of popular cigarette package employs a container having the form of a so-called "hard pack," also known as "crush proof box" or "hinged lid package." See, for example, U.S. Pat. Nos. 3,874,581 to Fox et al.; 3,858,788 to Phillips; 3,944,066 to Niepmann; 4,852,734 to Allen et al.; and 5,139,140 to Burrows et al., each of which is incorporated herein by reference in its entirety. Normally, both types of cigarette packs are packed in cartons, also of generally rectangular parallelepiped form, typically containing ten (10) packages.

The aforementioned types of conventional cigarette packages are designed to maintain the freshness and moisture content of the cigarettes and to protect the cigarettes from adverse environmental conditions which could degrade the freshness and quality of the cigarettes. Such conventional cigarette packages typically comprise three separate wrappings: (1) an inner foil liner comprising a metal foil laminated to a paper substrate or a metalized paper which is wrapped about the cigarettes and folded, but not sealed, at the ends of the cigarettes; (2) a "soft" or "hard" paper or paperboard package which is usually imprinted with brand specific-information; and (3) an exterior clear overwrap of a heat-sealable polymeric film which is heat sealed.

Cigarettes, or cigarette packages, have been marketed and offered with buy-one-get-one-free promotions or monetary discount promotions. For these promotions, multiple single cigarette packages are packaged together into pre-formed/pre-glued paper board sleeves. The exterior surface of the sleeve is printed with advertising for the offer, UPC codes, and other required information. These sleeved offers hold the multiple cigarette packages together until the customer, after purchase, removes the single cigarette packages and discards the sleeve.

Conventionally, the paper board sleeves, after print, are manually formed and glued. To assemble the sleeved offers, single cigarette packages are manually removed from 10-pack cartons, manually inserted into the paper sleeves, and manually returned into the carton, if possible, for shipment. Although automated cartoning machines exist for packing 10-pack cartons, it is typically not feasible to reuse previously manufactured cartons in the cartoning machine. Thus, during the re-cartoning process, either the existing carton would be discarded and not used at all for the sleeved offers, or a manual process would be required to reuse the cartons by filling it with the sleeved offers.

Current promotional sleeve production costs using manual techniques can be expensive. Thus, there remains a need for packing at least one, and preferably, multiple cigarette packages with a paper sleeved offer by means of a lower cost automated process and equipment designed for such. It is also desirable to carton the sleeved offers with an automated process and equipment.

SUMMARY

In a first embodiment, a machine for sleeving one or more packages of smoking articles is provided. The high-speed automated machine can both provide sleeves and fold sleeves around one or more individual packages that have already been wrapped and sealed with the polymeric film and prepared for commercial usage. This offers significant reduction in overall labor costs needed to wrap sleeves around the package(s).

The machine includes a sleeve folding station configured to receive and orient a blank of sleeve material to be folded around the package(s). The sleeve folding station is configured to permit at least one fold in the blank when the bundle is moved against the blank. The machine also includes a transfer unit coupled to the sleeve folding station and operatively coupled to a drive train, and configured to move the package(s) to contact the blank at the sleeve folding station.

The transfer unit can include a second conveyor operatively coupled to the drive train and configured to move the package(s) to the sleeve folding station. The transfer unit may also include a transfer wheel located at the end of a second conveyor and having at least one pocket located circumferentially along the transfer wheel. The pocket of the transfer wheel is configured to receive the package(s) from the second conveyor, and the transfer wheel is operatively coupled to the drive train to rotatably index about an axis in order to move the package(s) to the sleeve folding station. Preferably, the transfer unit includes a stepped guide unit located between the transfer wheel and the second conveyor. The stepped guide unit is configured to receive the package(s) from each of the bundling pocket guides, and is configured to move the bundle vertically to a position for insertion into the transfer wheel pocket.

The machine can also include a folding transfer wheel having one or more pockets located circumferentially along the folding transfer wheel. The blank is foldable at least once upon insertion of the package(s) and blank together into the folding transfer wheel pocket. The folding transfer wheel is operatively coupled to the drive train to rotatably index about an axis in order to move the package(s) having the folded blank away from the sleeve folding station. Upon rotation of the folding transfer wheel, the blank preferably has a series of folds to place the blank circumferentially around said bundle so that a first end of the blank is contactable with a second end of the blank to form a sleeved bundle. The machine may also have at least one exit transfer wheel including at least one pocket located circumferentially along the exit transfer wheel. The pocket of the exit transfer wheel is configured to receive said bundle with folded blank, with the exit transfer wheel operatively coupled to the drive train to rotatably index about an axis in order to move the package(s) with folded blank away from the folding transfer wheel.

In one aspect of the first embodiment, the machine includes a bundling unit that is configured to combine at least two individual packages in order to form a bundle. The bundling unit can include a series of bundling pocket guides coupled to a conveyor. The bundling pocket guide is configured to receive two or more individual packages from another conveyor. The bundling unit may also have a pusher adapted to move a first individual package from a first conveyor into the bundling pocket guide of a second conveyor, and a second individual package from the first conveyor into the bundling pocket guide having the first individual package such that the first and second individual packages are adjacent to one another within the bundling pocket guide.

In another aspect of the first embodiment, the machine includes a sleeve handling system that includes a sleeve roller assembly, the sleeve folding station described above, and a cutting station located between the sleeve roller assembly and the sleeve folding station. The sleeve roller assembly can include one or more rolls of continuous sleeve material, and is configured to move the sleeve material from the roll and to the sleeve folding station. The cutting station is configured to sever a blank from the sleeve material. The continuous reel of paper is preferably pre-printed with the promotional wording and graphics. The sleeve handling system can also include a hot-melt adhesive applicator located between the cutting station and the sleeve folding station, with the applicator configured to apply preferably a hot-melt adhesive to selected portions of the blank of sleeve material. Preferably, the blank of sleeve material is oriented vertically, and the at least one package is oriented horizontally in alignment with the folding transfer wheel pocket. Upon insertion of the package(s) into the folding transfer wheel pocket, the blank has a first fold and a second fold such the blank contacts three surfaces of the package(s). Also, upon rotation of the folding transfer wheel, the blank has a third fold and a fourth fold to place the blank circumferentially around the package(s) so that a first end of the blank is contactable with a second end of the blank to form a sleeved package.

In a second embodiment, a method of sleeving one or more individual packages with a sleeve is provided. The method can include at least one of the following steps: feeding successive individual packages along a transfer unit to a sleeve folding station; feeding a blank of sleeve material to an adhesive applicator, the blank being sized to wrap at least one individual package; applying adhesive to a first portion of the blank of sleeve material; moving the at least one individual package against the blank of sleeve material having the adhesive into a pocket; and folding the blank of sleeve material around the at least one individual package so that the first portion is pressed against a second portion in order to form a sleeved individual package of smoking articles. The method may also include one of the following steps: forming the blank of sleeve material from a roll of continuous sleeve material; arranging a first individual package adjacent to a second individual package to form a bundle of packages; moving the bundle against a middle region of the blank into the pocket so that a fold is formed along at least one edge of the bundle; moving the bundle against a middle region of the blank into the pocket so that a first fold and a second fold are formed along two different edges of the bundle, the blank contacting three surfaces of the bundle; folding the blank along a third edge of the bundle such that the blank contacts a fourth surface of the bundle; and folding the blank along a fourth edge of the bundle in order to contact the fourth surface of the bundle.

Further objects, features, and advantages will become readily apparent to those skilled in the art after a review of the following detailed description of the preferred embodiments, with reference to the accompanying figures.

DESCRIPTION OF PREFERRED EMBODIMENTS

Figure 1:
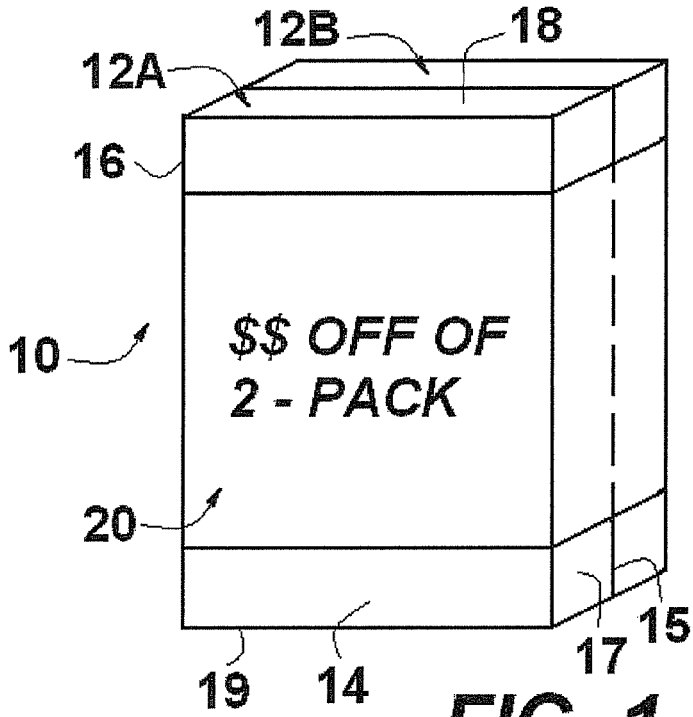
FIG. 1 is a perspective view of an assembly of two packages of smoking articles enwrapped by a sleeve.

FIG. 1 depicts an assembly 10 of two packages 12A, 12B of smoking articles, such as cigarettes, inserted within and enwrapped by a promotional sleeve 20, although the sleeve 20 can be wrapped around only one pack or optionally more than two packs. Like components are given like numeric designations throughout the figures. Promotional sleeves 20 are particularly useful in packaging multiple packages, such as, for example, buy-one-get-one-free packs or extra money off of two packs.

Smoking articles package 12 can be a "soft pack" or "hard pack," typically containing twenty cigarettes arranged in a 7-6-7 matrix within the package, although the package can hold any number of smoking articles. The package typically includes an inner wrap and an outer printed or label wrap. A preferred inner wrap is a metal foil/paper laminate, such as aluminum foil adhesively bonded to pound bond paper. The outer label wrap is preferably a paper material, such as clay coated 44 pound litho sheet and includes printed indicia (e.g., designs, graphics, brand-specific information, etc.) positioned on a specific wall surface of the package and corresponding with the printed indicia on the overwrap material. Totally enwrapping the outside surface of the package is an exterior clear overwrap of a heat sealable polymeric film which is heat sealed. The "hard pack" is typically manufactured from a resilient paperboard material, such as a low density, solid bleached sulfate paperboard having a thickness of about 0.012 inches.

For illustrative purposes only, the packages 12A, 12B shown in the figures are hard pack packages. Package 12A is shown in FIG. 1 to have a front side 14, a back side 15, a right side 16, a left side 17, a top side 18, and a bottom side 19, respectively.

Figure 2:
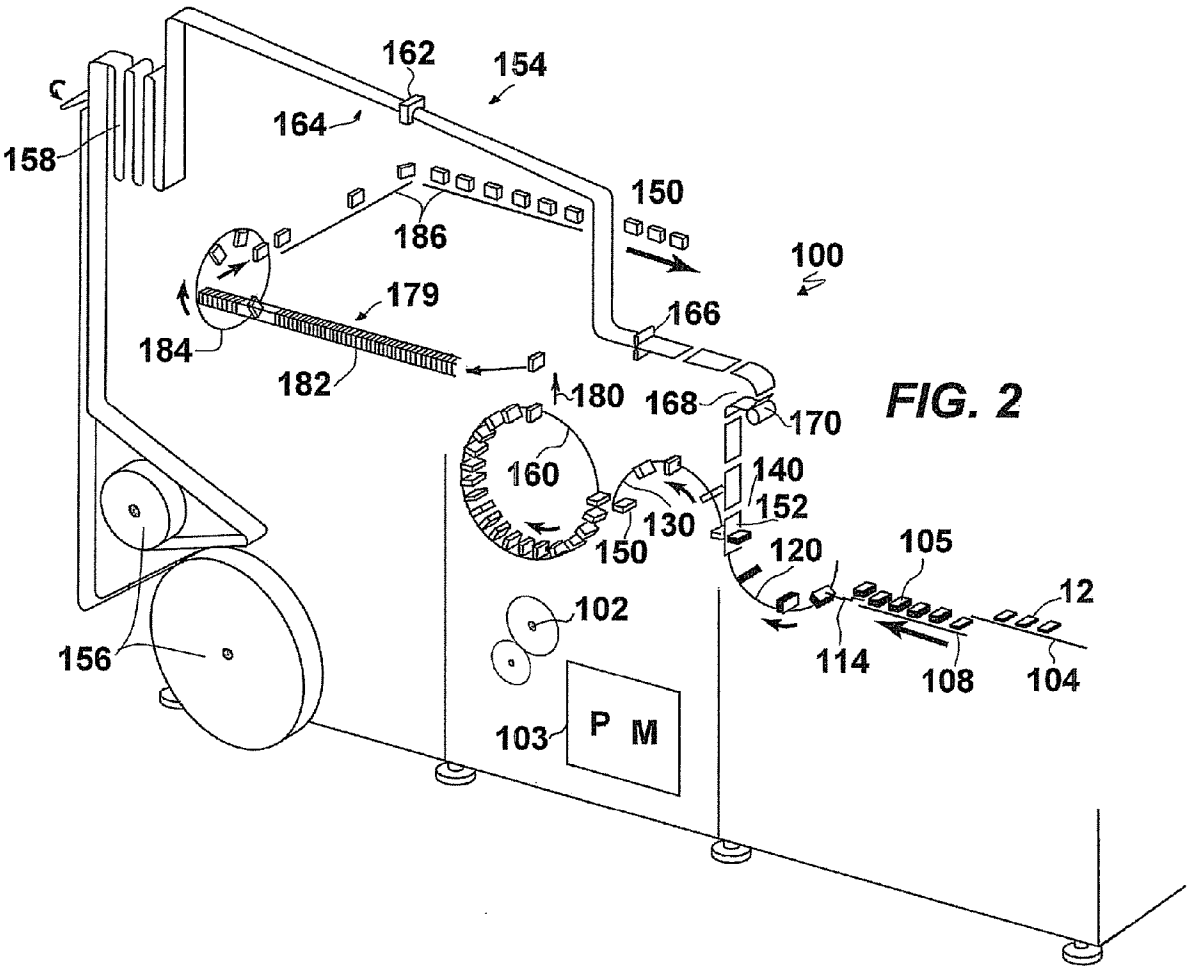
FIG. 2 is a schematic representation of a general layout of a packaging machine.

FIG. 2 is a schematic representation of a general layout depicting a preferred embodiment of a packaging machine 100, such as a uniquely modified G.D. X-500 soft packer, which is manufactured and sold by G.D. S.P.A. of Bologna, Italy, adapted to enwrap one or more packages with a sleeve cut from a continuous roll of paper. However, the teachings of the preferred embodiments may be readily applied to other commercially available packaging machines upon a reading and understanding of the detailed description that follows. The machine 100 includes a drive train system 102 adapted to drive the translational movement of the packages and/or the sleeves throughout the machine. A system controller 103 comprising a processor P and memory M is provided for selectively controlling the speed and operation of the machine, and is operatively coupled to each of the components of the machine via communication lines for communicating data therewith as known in the art.

The machine 100 can include a receiving section (not shown) configured to receive individual packages 12 in place of the cigarette downdrop and hopper module of the GD. X-500. In one embodiment, the machine 100 can collate individual packages 12 of smoking articles from a hopper, preferably into a plurality of package bundles (usually 2 packages per bundle). Alternatively, smoking articles packages 12 can be placed as individual packages or as bundles of multiple packages on an infeed conveyor 104. For example, in FIG. 3A individual packages 12 are shown oriented widthwise or flatly on its front-to-back sides, in a side-by-side configuration with adjacent packages, being transferred on the infeed conveyor 104, although the packages can be oriented in any fashion. From this point forward reference will be made to bundles of packages, and it is to be understood by persons of ordinary skill in the art that the teachings of the preferred embodiments including bundles may be readily applied to applying a sleeve around a single package.

Figure 3A:
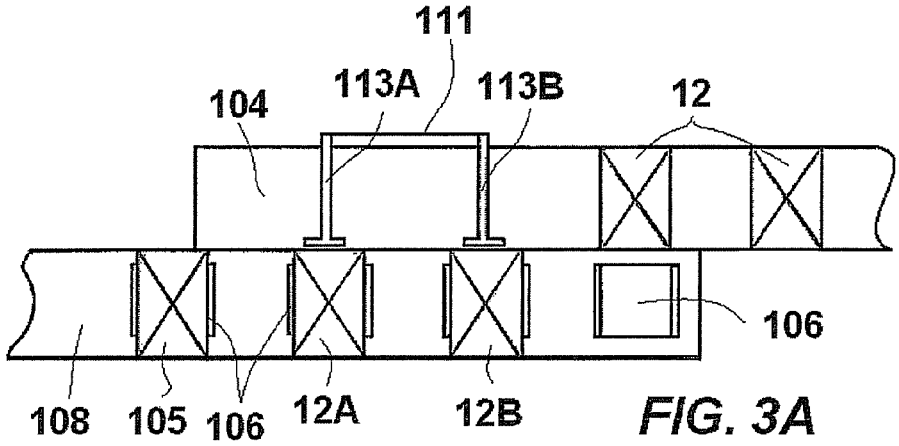
FIG. 3A is a top view of one embodiment depicting the transfer of packages to a pocket guide.
Figure 3B:
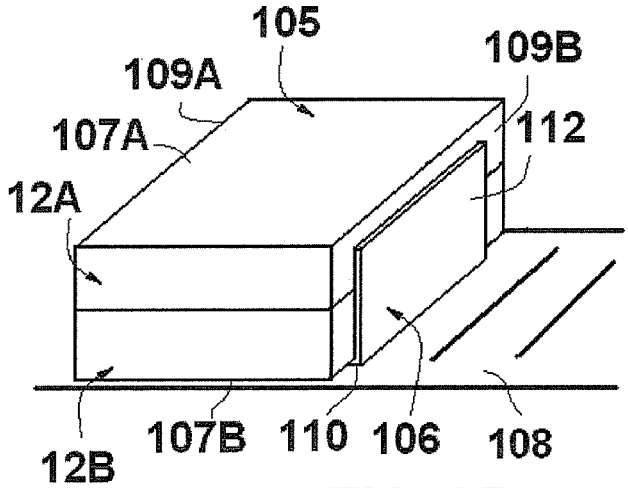
FIG. 3B is a perspective view of two packages of smoking articles within a pocket guide.

To this end, FIG. 3B illustrates one configuration of a bundle 105 of packages 12A, 12B that are oriented widthwise or flatly on its front-to-back sides, with one package on top of another. In this configuration, the bundle 105 includes a top side 107A, a bottom side 107B, and left and right sides 109A, 109B. According to FIG. 3B, the packages forming the bundles 105 can be inserted into a series of pocket guides 106 that are attached to a transfer belt 108. The pocket guides 106 can have a bottom 110 and sidewalls 112, and may have a top where the bundles are inserted from a side. Preferably, the pocket guides 106 are open-ended at the top, as shown, where individual packages can be inserted from the top. The height of the sidewalls 112 need only be sufficient to retain all the packages within the pocket guide 106. FIG. 3B illustrates one embodiment of the pocket guide 106 and the relative position of the second pack 12A inserted on top of the first pack 12B. Preferably, the first pack is inserted first at the bottom of the pocket guide and additional packs are inserted on top of one another.

FIG. 3A shows one embodiment of the relative position of the infeed conveyor 104 along the side of the transfer belt 108. Also shown is a reciprocating mechanical pusher 111 that can be a modified version of the cigarette pusher of G.D. X-500, and can have a stroke length of about 90 mm to about 105 mm. The pusher 111 includes a first portion 113A configured to move the first pack 12B from the infeed conveyor 104 into the pocket 106 of the transfer belt 108, and a second portion 113B configured to move the second pack 12A into the pocket 106, on top of the first pack. The first and second portions 113A, 113B of the pusher 111 can be coupled so that the portions 113A, 113B move simultaneously. Optionally, the first and second portions 113A, 113B of the pusher 111 can be individual pushers configured to move at different times. The longitudinal spacing between the first and second portions 113A, 113B and the rate of speed and timing between the infeed conveyor 104 and the transfer belt 108 can be coordinated such that, after the first and second portions 113A, 113B of pusher 111 move a package to their respective pockets 106, the pusher 111 withdraws and moves again in a reciprocating manner when another package is aligned for movement into a pocket. More than two contacting portions of the pusher, or more than one pusher, may be used depending on the number of packages per a bundle.

Referring back to FIG. 2, the transfer belt 108 moves incrementally in order to transfer the bundles 105 in succession from the receiving section to be then inserted into the "first wheel" (represented by dashed line labeled 115 in FIG. 4) of the GD. X-500, which may be preferable for one-pack bundles. Means for detecting empty pockets, detecting misaligned packages, and/or detecting missing bundles can be included along the transfer belt 108 in the form of sensors that communicate to the system controller 103. A top guide configured to prevent packages of bundles from rising out of the pockets during transfer may also be included along the transfer belt 108.

Figure 4:
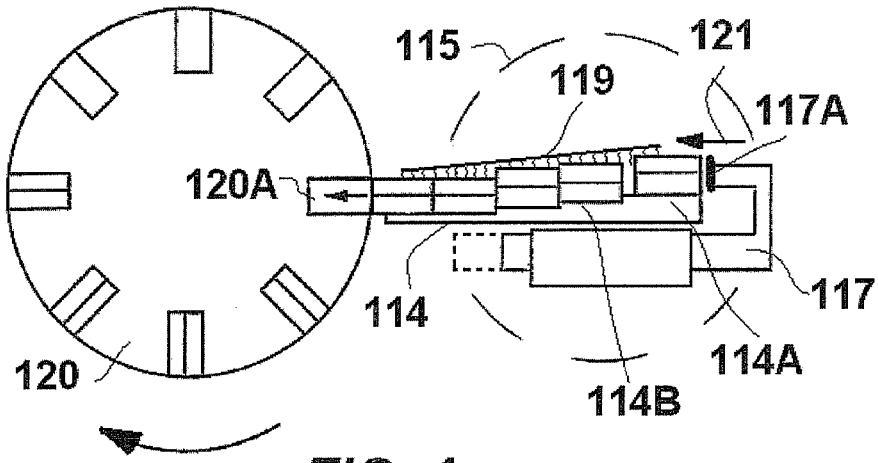
FIG. 4 is a schematic representation of a stepped fixed guide of a packaging machine.

Optionally, in place of the "first wheel" of the G.D. X-500, the machine 100 may include an inclined guide or a stepped fixed guide 114, as shown in FIG. 4. The inclined guide may permit misalignment of the bundle while attempting to push the bundle within the second wheel of the G.D. X-500. Preferably, a portion of the transfer belt 108 is located adjacent the stepped fixed guide 114 so that the bundles 105 can be laterally moved into place on the first step 114A from the side. A mechanical pusher (not shown) can be oriented proximate the transfer belt 108 and configured to push each bundle 105 from the pocket 106 to the first step 114A of the stepped fixed guide 114. Alternatively, transfer of the bundle 105 may be made by pneumatic means, such as by positive or negative pressure.

The stepped fixed guide 114 is configured to translate and situate the bundles 105 to a position for insertion into a pocket 120A of a rotational machine wheel used for positioning the bundle, the "second wheel" 120 of the GD. X-500. The stepped fixed guide 114 includes a series of steps that are oriented to adjust vertically the position of the bundle to a position for insertion into the pocket 120A of the second wheel 120. For example, for a two-pack bundle the difference in elevation is about 22 mm to about 23 mm or the depth of an individual package. It was found that with the conventional setup of the G.D. X-500, it would be difficult for the conventional first wheel to handle a two-pack bundle, and the position of the bundle was not in alignment with the pocket 120A of the second wheel 120 with a two-pack bundle moving from the transfer belt. The stepped fixed guide 114 is sized to fit where the first wheel would have been located, and preferably the existing pusher used for transfer to the conventional first wheel is used with some additional modifications.

Since the bundles must drop in elevation at such a short longitudinal distance to the pocket 120A of the second wheel 120, the number of steps and the riser of each step are optimized to facilitate the movement and transfer of force between adjacent bundles. Preferably, the riser of each step is sufficient to permit enough contact area between adjacent bundles to press against one another in order to cause movement thereof. In the example shown there are three steps having a riser distance of up to 10 mm, while the tread depth of each step is about the same as the width along the front or back side of the bundle. The last step can have a longer tread depth in order to facilitate alignment of the bundles before insertion into the second wheel. When the riser distance is too high, the higher elevated bundle tends to pivot about the top edge of the lower adjacent bundle, and the lower bundle tends to rotate when contacted at a higher point than its center of gravity. To further prevent these tendencies and the bundles from popping vertically, a top guide 119 can be aligned along the top of the bundles as shown, preferably having bristles in order to impart minimal resistance to the movement of the bundles.

In cooperation with the stepped fixed guide 114 is a pusher 117 adapted to apply a force against the side of the bundle, preferably a modified version of the existing pusher. The pusher 117 is a reciprocating mechanical pusher having a stroke length (represented by the dashed lines) and a force, represented by arrow 121, sufficient to move the first bundle on step 114A against the adjacent bundle and onto step 114B such that the force from the first bundle is transferred all the way to the end bundle that is adjacent the pocket 120A of the second wheel 120. In other words, a portion 117A of the pusher 117 contacts the first bundle and moves the first bundle against the adjacent bundle. The first bundle is moved to the next step 114B, which causes a chain reaction of movement and force transfer between adjacent bundles until the end bundle is moved into the pocket 120A, shown by the arrow.

At an exit portion of the stepped fixed guide 114, a plunger can further push the bundle 105 into pockets 120A of the second wheel 120. The foil reel and feeding sections of the G.D. X-500 are removed from the entrance of the second wheel. The pockets 120A of the second wheel 120 are spaced apart, preferably equiangularly, and are shaped to define a space suitably dimensioned to receive a bundle of packages.

Figure 5:
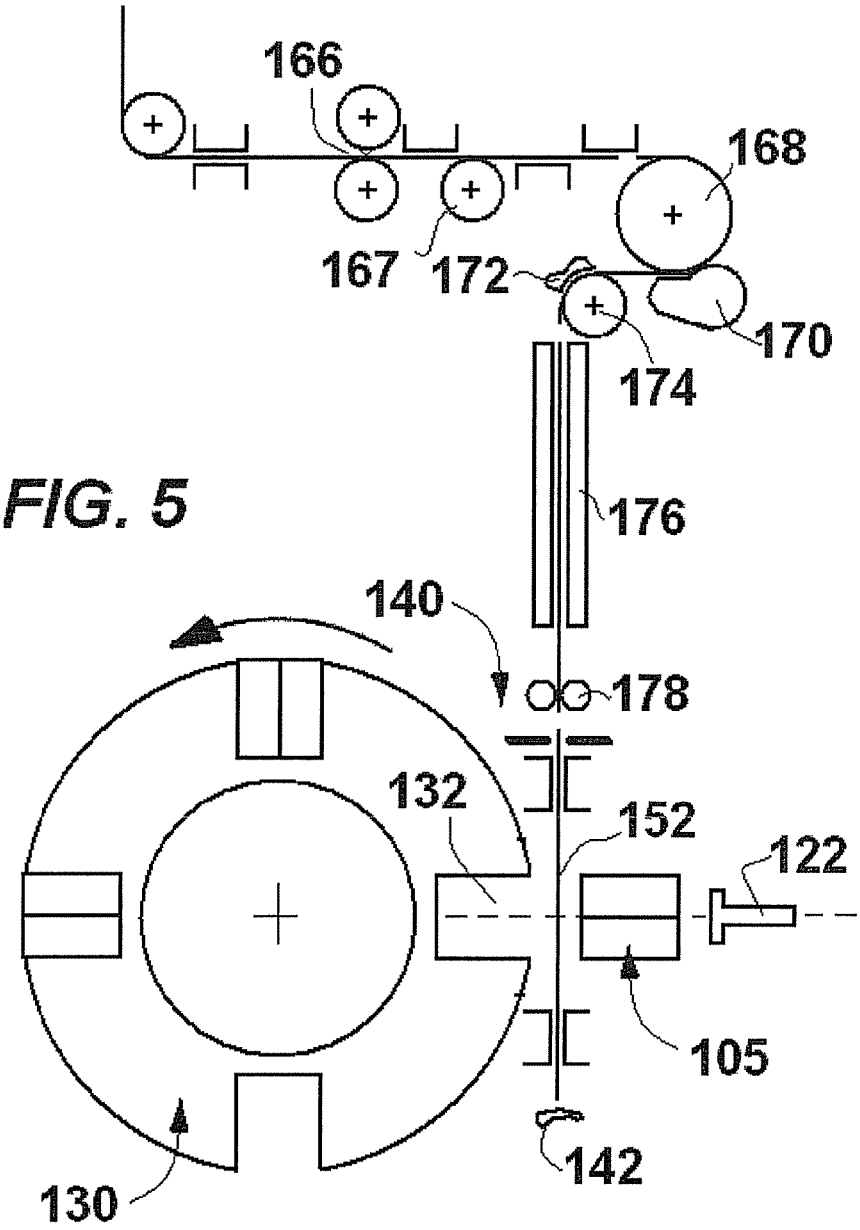
FIG. 5 is a schematic representation of a sleeve folding station of a packaging machine.

The second wheel 120 can rotate incrementally, clockwise (shown) or counterclockwise, such that the bundle 105 is situated adjacent a pocket of another rotational machine wheel used for folding, "the third wheel" 130 of the G.D. X-500, and a sleeve folding station 140. The third wheel 130 also includes a series of pockets 132, as shown in FIG. 5, spaced apart, preferably equiangularly, and shaped to define a space dimensioned to receive a sleeved bundle 150 of packages. Upon transfer of the bundle 105 to the pocket 132, the bundle 105 interfaces with a sleeve 152 which is also transferred to the pocket 132. Transfer of the bundle 105 may be by mechanical means, such as a pusher 122 configured to transfer the bundles from the second wheel 120 to the third wheel 130, or by pneumatic means, such as by positive or negative pressure. The third wheel 130 can rotate incrementally, clockwise or counterclockwise (shown), such that upon passage about arcuate portions of the third wheel 130 and transfer to and motion about another rotational machine wheel, "the fourth wheel" 160 of the G.D. X-500 (shown in FIG. 2), the sleeve 152 is wrapped and folded into final form about the bundle 105 of packages of smoking articles to form a sleeved bundle 150.

To supply the sleeves 152, the machine 100 also includes a sleeve roller assembly 154 configured to repetitively direct paper from at least one reel 156 to the sleeve folding station 140. The system controller 103 can be configured to timely execute the cutting and folding operation at the folding station. Before entering the fourth wheel 160, the paper for the sleeves 152 is preferably fed from one or more continuous reels 156 through a system of tension rollers 158 configured to remove slack out of roll and one or more decurlers or guides 162. Because the paper for sleeves is provided on a reel instead of the conventional pre-glued/pre-fab sleeves, the paper can be purchased at a reduced cost-per-sleeve price, and the handling costs-per-sleeve by using the reels can also be reduced. The continuous supply of paper can pass along a horizontal path portion 164, along which is located a cutting station 166 configured to sever paper from the roll to a size sufficient to wrap the bundles. In one example, the sleeves 152 are cut to about 220 mm to 230 mm for wrapping a two-pack bundle. The cutting station 166 may include a detector for establishing a signal to the system controller 103 that the continuous roll of paper is adjacent the cutting station. The cutting station 166, preferably a rotary cutter, severs the paper from the remainder of the roll to form the sleeve 152. Means for detecting paper, for missing paper, for detecting paper jams, for detecting sleeve misalignment, and the like can be included along the sleeve roller assembly and/or sleeve folding section in the form of sensors that communicate with the system controller 103.

With reference to FIGS. 2 and 5, upon completion of the severing step of the cutting station 166, a pressure roller 167 in cooperation with a guide directs the sleeve 152 into a vacuum drum 168, which is configured to hold the sleeve while glue is being applied by a glue applicator 170. The glue applicator 170 is configured to apply adhesive, preferably in the form of liquid glue or hot-melt adhesive, to the sleeve 152. The glue applicator 170 includes a glue pot for containing the glue and glue applicators which apply the glue to the selected portions 153 of the sleeve 152. The internal drives for the vacuum drum and/or the glue applicator can be increased to a rate to accommodate the longer sleeves for the bundles. For example, the rate may be increased to 1 RPM/pack cycle to accommodate a two-pack bundle. The modified rate can be arrived at by modifying the drive train 102 or other drive train system components to change to a suitable driving ratio, as can be appreciated by persons of ordinary skill in the art.

After applying the glue, the sleeve 152 can move through a guide plate 172 adapted to guide the sleeve from the glue applicator 170 to the sleeve folding section 140 and around a sleeve feed roller 174 adapted to transfer the sleeve 152 from the glue applicator 170 to the sleeve folding section 140. From the sleeve feed roller 174, the sleeve 152 can enter a vertical guide plate 176 configured to align and feed the sleeve to the sleeve folding section 140 and to sleeve accelerator rollers 178 where the sleeve 152 is fed to a vertically adjustable sleeve stop 142. The sleeve accelerator rollers 178 are adapted to increase the rate of the sleeves coming into the folding station in order to increase the gap of separation from successive sleeves. The sleeve stop 142 is configured to stop the sleeve 152 at a suitable position to meet the bundles 105. The vertically adjustable sleeve stop 142 is further configured to place the received sleeve 152 in a desired position relative to the third wheel 130 and the pusher 122 of the second wheel 120. The pusher 122 urges the bundle 105 from the pocket of the second wheel 120 and through the folding station 140 so as to plunge the bundle 105 together with the sleeve 152 into the pocket 132 of the third wheel 130. The position of the sleeve accelerator roller 178 can be adjusted upward by a suitable distance to accommodate the longer sleeves, for example, for a two-pack bundle the adjustment is approximately 20 mm. The sleeve stop 142 may also need to be adjusted for a much lower stop position to accommodate the longer sleeves.

Figure 6A:
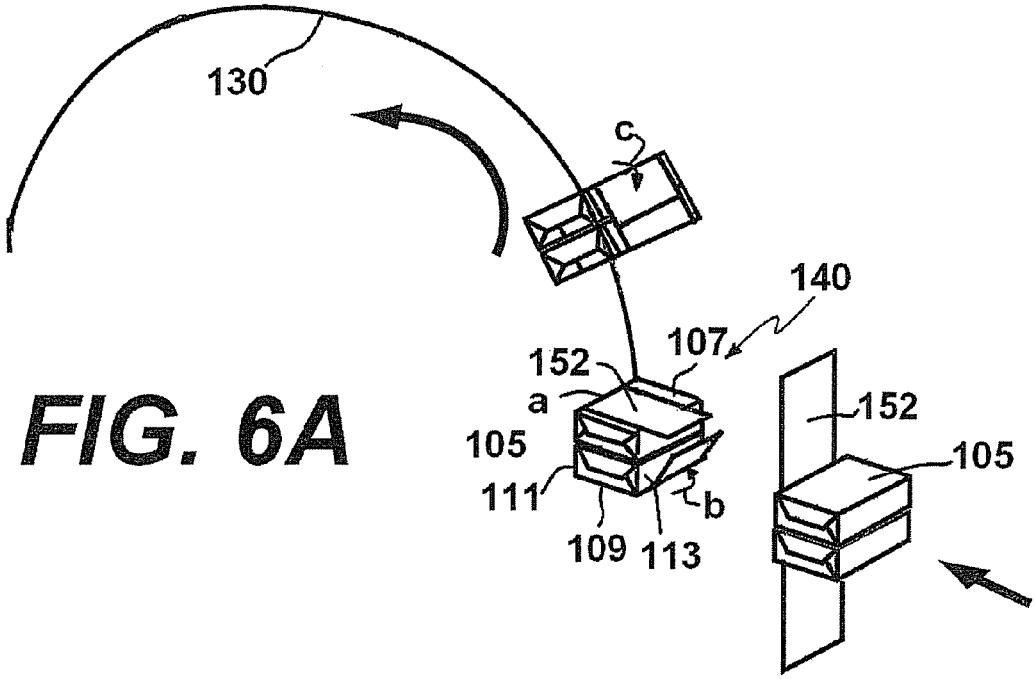
FIG. 6A is a schematic representation of a series of folds of a sleeve around a bundle.
Figure 6B:
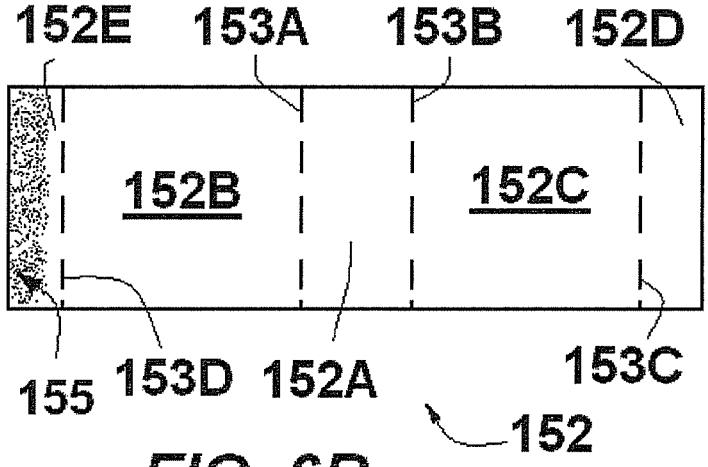
FIG. 6B is a top view of a blank of sleeve material depicting fold lines.

With reference to FIG. 6A, at the sleeve folding section 140 and with rotation of the third wheel 130, the sleeve 152 can be folded around each bundle 105 with a series of folds. As described earlier, the pusher 122 urges the bundle 105 through the folding station 140 so as to move or plunge the bundle 105 against the sleeve 152 into the pocket 132 of the third wheel 130 (step a). With additional reference to FIG. 6B, one of the sides 109A or 109B of the bundle 105 preferably contacts a middle region 152A of the sleeve 152 to create two fold lines 153A, 153B and align a first adjacent portion 152B along the top side 107A of the bundle 105 and a second adjacent portion 152C along the bottom side 107B of the bundle 105. Thus, the sleeve is applied against three surfaces of the bundle. Before the initial rotation of the third wheel 130, or afterwards, another portion 152D is folded against the side 109A or 109B of the bundle 105, represented by the arrow, to create a third fold line 153C (step b). The third wheel 130 is again rotated, and another portion 152E is folded along another fold line 153D, represented by the arrow, against the same side 109A or 109B as portion 152D such that the adhesive portion 155 of portion 152E adhesively contacts portion 152D (step c) to form the sleeved bundle 150.

The sleeves 152 may be fabricated from paper or any other suitable material. In one example, the sleeve material is SBS (solid bleached sulfate) board having a clay coating on one side for quality printing and having a general thickness of about 0.012 inches. In a preferred embodiment, the sleeve material is a C1S (coated one side) paper. The C1S paper is generally provided in 50 pounds per ream (3000 square feet of paper typically in a ream) and typically having a thickness of about 0.004 inches. The blanks of the sleeves can be cut to size and assembled by folding along the fold lines between adjacent panel portions. With the high speed automation of the sleeving process, significant reductions in labor costs are provided. The folding process shown in the figures is for general illustrative purposes, and it is to be understood by one skilled in the art that equivalent folding processes are within the scope of the present invention.

Referring back to FIG. 2, the fourth wheel 160 also includes a series of pockets spaced, preferably equiangularly, along the outer portion of the fourth wheel. The pockets are sized to receive and maintain at least a sleeved bundle 150. The number of pockets will dictate the angular spacing of the pockets with respect to one another. In one example, eighteen (18) pockets can be spaced apart such that there are 20 degrees between the pockets. In another example, twenty-four (24) pockets can be spaced apart by 15 degrees. Consequently, the angled spacing between the pockets permit the fourth wheel 160 to rotate incrementally at said angle. Alternatively, the effective outside radius of the fourth wheel 160 can be increased sufficiently to accommodate the larger bundle sizes. A heater (not shown) may be disposed near the fourth wheel 160. The heat supplied by the heater is sufficient to dry glue (adhesive) between the sleeves. In addition, the fourth wheel may be incrementally rotated at a slower rate in order to allow for sufficient time to dry the adhesive.

Upon incremental rotation of the fourth wheel 160, clockwise (shown) or counterclockwise, the sleeve bundles 150 are positioned such that the sleeved bundles 150 can be placed on an exit belt section 179 along the side 109A or 109B of the bundle, stacked side-to-side with adjacent bundles as shown. This generally occurs using a vertical exit 180 or elevator that has a cross-section sized to accommodate the larger bundles. The sleeved bundle 150 may then be oriented onto one or more exit belts 182 via one or more pushers (not shown). The stroke of the exit belt pusher of the G.D. X-500 may need to be longer to accommodate the multiple pack bundles, for example, for a two-pack bundle the stroke can be increased to about 47 mm. Means for detecting empty pockets, detecting misaligned bundles, and/or detecting missing bundles can be included along the fourth wheel and/or the exit belt in the form of sensors communicating with the system controller 103.

Further, the rate of the exit belt section 179 may need to be increased to provide an increase in rotation per pack cycle in order to accommodate the larger sleeved bundles 150. One embodiment includes increasing the dimensions of the belt pulley (not shown) by a sufficient amount for the desired speed, although there may be space limitation. Alternatively, the rate of the drive train of the exit belt may be increased. In another embodiment, a motor may be combined with a servo drive to force longer belt movement strokes. In other embodiments, the exit belt section can be decoupled from its mechanical drive and converted to a brushless drive.

The exit belts 182 are configured to translate the successive sleeved bundles 150 to another rotatable machine wheel, or "fifth wheel" 184 of the G.D. X-500, oriented perpendicular to the exit belt and the other wheels. The fifth wheel 184 includes a series of pockets spaced, preferably equiangularly, along the outer portion of the fifth wheel. The pockets of the fifth wheel are sized to receive and maintain the sleeved bundle 150. The fifth wheel 184 is configured to transfer the sleeved bundles 150 from the exit belt section 179 to a pack conveyor belt 186, such that the bundles are oriented along the side 109A or 109B in a top-to-bottom configuration with adjacent bundles as shown.

Each of the first, second, third, fourth and fifth wheels is preferably driven by the drive train system 102 of the machine 100, such as is typically provided in the G.D. X-500 packing machines. The drive train system 102 can include one or more drives operatively coupled via gears to the machine components to provide movement thereof. Pockets of the various wheels are generally located along the circumference of the wheel and oriented so that the pocket extends radially from an axis of the wheel. Pockets of the wheels travel about the axis along a circular path as the wheel is rotatably indexed at predetermined increments. Upon transfer, the pockets of adjacent wheels are arrested and positioned in sufficient alignment to permit the bundles to easily transfer from one wheel to another. Each of the pushers described herein may also include a mechanical follower to facilitate setting the bundle into place.

Figure 7:
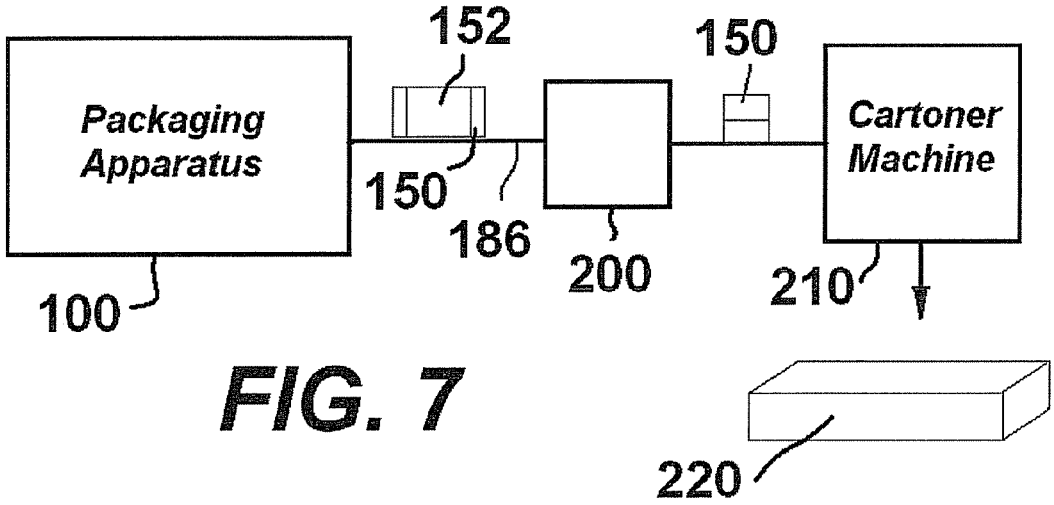
FIG. 7 is a schematic representation of a packaging machine and cartoner machine.

The pack conveyor belt 186 is configured to transfer the sleeved bundles 150 to a second machine 200, shown in FIG. 7, adapted to reorient the bundles 150 into a vertical configuration for transferring to a cartoner machine 210. The second machine 200 can be a modified packaging machine known as the G.D. 4350 or later version G.D. C600, which is manufactured and sold by G.D. S.P.A. However, the teachings described herein may be readily applied to other commercially available cigarette packaging machines upon a reading and understanding of the detailed description. The overwrapping of the film, however, is not required for the sleeved bundles. Thus, the modified GD. 4350 can be used to transfer the sleeved bundles to the exit wheel for transfer to the cartoner machine 210, such as a G.D. BB-CT, which is also manufactured and sold by GD. S.P.A. The film feeding, tear tape feeding, and wrapping wheels sections can be removed from the modified GD. 4350. The infeed sleeved bundles can be directly placed at the entrance of the elevator configured to receive and move a sleeved bundle. The rate of movement from the elevator is modified to accommodate the larger bundles. For example, for a two-pack, the elevating movement would need to be about 50% of its normal speed. After elevation, a pusher configured to transfer a multiple pack bundle can urge the sleeved bundles into a series of pockets of the exit wheel. The exit wheel can be rotated at predetermined increments to a transfer position where sleeved bundles are transferred by a pusher to another transfer belt that is configured to transfer the sleeved bundles to the cartoner machine 210. At the cartoner machine 210, the sleeved bundles can then be automatedly wrapped with carton board to form a carton 220 of bundles. When there are two-pack bundles, typically the carton 220 will contain 5 sleeved two-pack bundles, i.e., 10 packages per carton. After cartoning, the carton 220 of bundles can be fed to casepacking and/or palletizing equipment.

Drawings in the figures illustrating various embodiments are not necessarily to scale. Some drawings may have certain details magnified for emphasis, and any different numbers or proportions of parts should not be read as limiting, unless so-designated by one or more claims. Those of skill in the art will appreciate that embodiments not expressly illustrated herein may be practiced within the scope of the present invention, including that features described herein for different embodiments may be combined with each other and/or with currently-known or future-developed technologies while remaining within the scope of the claims presented here. It is therefore intended that the foregoing detailed description be regarded as illustrative rather than limiting. And, it should be understood that the following claims, including all equivalents, are intended to define the spirit and scope of this invention.

The invention claimed is:

1. A machine for sleeving two or more individual packages of smoking articles, each package sealed with a polymeric film, the machine comprising:

a bundling unit configured to combine at least two individual packages so that a bundle of packages is formed;

a sleeve folding station configured to receive a blank of sleeve material and orient said blank to be foldable around said bundle;

a drive train;

a first conveyor operatively coupled to the drive train and configured to transfer a plurality of individual packages to the bundling unit; and a transfer unit comprising a second conveyor coupled between the bundling unit and the sleeve folding station, the transfer unit operatively coupled to the drive train and configured to move said bundle to contact the blank at the sleeve folding station, wherein the first and second conveyors are oriented side-by-side, wherein the bundling unit comprises a series of bundling pocket guides coupled to the second conveyor, the bundling pocket guide being configured to receive two or more individual packages from the first conveyor.

2. The machine of claim 1, wherein the bundling unit comprises a pusher adapted to move a first individual package from the first conveyor into the bundling pocket guide of the second conveyor, and a second individual package from the first conveyor into the bundling pocket guide having the first individual package such that the first and second individual packages are adjacent to one another within the bundling pocket guide.

3. The machine of claim 1, wherein the transfer unit further comprises a transfer wheel located at the end of the second conveyor and having at least one pocket located circumferentially along the transfer wheel, the pocket of the transfer wheel configured to receive said bundle from the second conveyor, the transfer wheel operatively coupled to the drive train to rotatably index about an axis in order to move said bundle to the sleeve folding station.

4. The machine of claim 3, wherein the transfer unit further comprises a stepped guide unit located between the transfer wheel and the second conveyor and configured to receive said bundle from each of the bundling pocket guides, the stepped guide unit configured to move the bundle vertically to a position for insertion into the transfer wheel pocket.

5. The machine of claim 1 further comprising a folding transfer wheel including one or more pockets located circumferentially along the folding transfer wheel, the blank being foldable at least once upon insertion of said bundle and blank together into the folding transfer wheel pocket, the folding transfer wheel operatively coupled to the drive train to rotatably index about an axis in order to move said bundle having the folded blank away from the sleeve folding station.

6. The machine of claim 5, wherein upon rotation of the folding transfer wheel, the blank has a series of folds to place the blank circumferentially around said bundle so that a first end of the blank is contactable with a second end of the blank to form a sleeved bundle.

7. The machine of claim 5 further comprising at least one exit transfer wheel including at least one pocket located circumferentially along the exit transfer wheel, the pocket of the exit transfer wheel configured to receive said bundle with folded blank, the at least one exit transfer wheel operatively coupled to the drive train to rotatably index about an axis in order to move said bundle with folded blank away from the folding transfer wheel.

8. The machine of claim 5, wherein the sleeve folding station is configured to orient the blank of sleeve material orthogonal to the bundle, wherein upon insertion of the bundle into the pocket of the folding transfer wheel the blank comprises a first fold and a second fold such the blank is in contact with three surfaces of the bundle.

9. The machine of claim 8, wherein upon rotation of the folding transfer wheel, the blank further comprises a third fold and a fourth fold to place the blank circumferentially around the bundle so that a first end of the blank is contactable with a second end of the blank to form a sleeved bundle of pre-sealed packages.

10. The machine of claim 1 further comprising a sleeve roller assembly adapted to receive one or more rolls of continuous sleeve material and configured to move the sleeve material from the one or more rolls of continuous sleeve material to the sleeve folding station.

11. The machine of claim 10 further comprising a cutting station located between the sleeve roller assembly and the sleeve folding station, the cutting station configured to sever the sleeve material received from the sleeve roller assembly to form the blank of sleeve material.

12. The machine of claim 11 further comprising a hot-melt adhesive applicator located between the cutting station and the sleeve folding station, the hot-melt adhesive applicator configured to apply hot-melt adhesive to selected portions of the blank of sleeve material.

13. A machine for sleeving individual packages of smoking articles, each package pre-sealed with a polymeric film, the machine comprising:

a drive train;

a first transfer mechanism operatively coupled to the drive train and configured to transfer a plurality of individual pre-sealed packages;

a bundling unit configured to receive the pre-sealed packages from the first conveyor and form a bundle of pre-sealed packages;

a sleeve folding station configured to receive a blank of paper material and orient said blank to be foldable around said bundle; and a transfer station comprising a second transfer mechanism coupled between the bundling unit and the sleeve folding station, the transfer station configured to move said bundle to contact the blank at the sleeve folding station, wherein the second transfer mechanism and the first transfer mechanism are oriented side-by-side, wherein the bundling unit comprises a series of bundling pocket guides coupled to the second transfer mechanism, the bundling pocket guide being configured to receive two or more pre-sealed packages from the first transfer mechanism.

14. The machine of claim 13, wherein the bundling unit further comprises a first pusher mechanism configured to move a first pre-sealed package from the first transfer mechanism to a bottom of the bundling pocket guide of the second transfer mechanism, and a second pusher mechanism configured to move a second pre-sealed package from the first transfer mechanism into the bundling pocket guide directly on top of the first pre-sealed package such that the first and second pre-sealed packages are adjacent to one another within the bundling pocket guide.

15. The machine of claim 14, wherein the transfer station further comprises a transfer wheel located between the sleeve folding station and the second transfer mechanism, the transfer wheel having at least one pocket located circumferentially along the transfer wheel, the pocket of the transfer wheel configured to receive the bundle from the second transfer mechanism, the transfer wheel operatively coupled to the drive train to rotatably index about an axis in order to move said bundle to the sleeve folding station.

16. The machine of claim 15, wherein the transfer station further comprises a stepped guide unit located between the transfer wheel and the second transfer mechanism, the stepped guide unit configured to transfer said bundle from each of the bundling pocket guides to the pockets of the transfer wheel.

17. The machine of claim 13 further comprising:

a sleeve roller assembly adapted to receive one or more rolls of continuous paper material and configured to move the paper material from the one or more rolls of continuous paper material to the sleeve folding station;

a cutting station located between the sleeve roller assembly and the sleeve folding station, the cutting station configured to sever the paper material received from the sleeve roller assembly to form the blank of paper material; and an adhesive applicator located between the cutting station and the sleeve folding station, the applicator configured to apply an adhesive to selected portions of the blank of paper material.

18. The machine of claim 17, further comprising a folding transfer wheel including one or more pockets located circumferentially along the folding transfer wheel, wherein the sleeve folding station is configured to orient the blank of paper material orthogonal to the bundle, wherein upon insertion of the bundle into the pocket of the folding transfer wheel the blank comprises a first fold and a second fold.

19. The machine of claim 18, wherein upon rotation of the folding transfer wheel, the blank further comprises a third fold and a fourth fold to place the blank circumferentially around the bundle so that a first end of the blank is attached to a second end of the blank with the adhesive to form a sleeved bundle of pre-sealed packages.

20. A machine for sleeving individual packages of smoking articles, each package pre-sealed with a polymeric film, the machine comprising:

a drive train;

a first transfer mechanism operatively coupled to the drive train and configured to transfer a plurality of individual pre-sealed packages;

a bundling unit comprising a series of pocket guides configured to receive two or more pre-sealed packages from the first transfer mechanism and form a bundle of pre-sealed packages in each pocket guide;

a sleeve folding station configured to receive a blank of paper material and orient the blank to be foldable around the bundle; and a transfer station coupled between the bundling unit and the sleeve folding station and configured to move said bundle to contact the blank at the sleeve folding station, the transfer station comprising a second transfer mechanism operatively coupled to the drive train, wherein the second transfer mechanism and the first transfer mechanism are oriented side-by-side, wherein the pocket guides are coupled to the second transfer mechanism, wherein in response to contact between the bundle and the blank, the sleeve folding station is configured to fold and circumferentially wrap the blank around the bundle to form a sleeved bundle.

21. The machine of claim 20 further comprising a sleeve handling system adapted to provide the sleeve folding station a width of paper material sized to extend at least partially between top and bottom sides of the package.

22. The machine of claim 21, wherein the sleeve folding station is configured to fold the blank at a first fold, a second fold, a third fold, and a fourth fold to place the blank circumferentially around the bundle so that a first end of the blank is contactable with a second end of the blank to form a sleeved bundle of pre-sealed packages.

* * * * *